US005305576A

United States Patent [19]

Giles

[11] Patent Number: 5,305,576

[45] Date of Patent: Apr. 26, 1994

[54] METHOD OF CONSTRUCTING CURVILINEAR STRUCTURES

[76] Inventor: Brian C. Giles, 98 Main St. #339, Tiburon, Calif. 94920

[21] Appl. No.: 879,882

[22] Filed: May 7, 1992

[51] Int. Cl.[5] ..... E04B 1/32

[52] U.S. Cl. ..... 52/745.07; 52/116; 52/749; 249/209; 264/32

[58] Field of Search ..... 52/741.1, 745.07, 745.08, 52/81.2, 81.3, 81.4, 116, 117, 118, 119, 121, 749; 249/91, 93, 209; 264/32

[56] References Cited

U.S. PATENT DOCUMENTS

| | | | |
|---|---|---|---|
| 3,206,899 | 9/1965 | Wright | 264/32 |
| 3,365,855 | 1/1968 | Vermette | 52/745.07 |
| 3,380,203 | 4/1968 | Peterschmidt | 52/81.3 |
| 3,412,426 | 11/1968 | O'Dell, Jr. | 52/749 |
| 3,686,875 | 8/1972 | Morgan | 52/81.2 X |
| 4,155,967 | 5/1979 | South et al. | 264/32 |
| 4,548,590 | 10/1985 | Green | 446/116 X |
| 4,631,867 | 12/1986 | Reed | 264/32 |

FOREIGN PATENT DOCUMENTS

| | | | |
|---|---|---|---|
| 288423 | 3/1991 | Fed. Rep. of Germany | 249/209 |
| 1170151 | 7/1985 | U.S.S.R. | 52/745.07 |
| 1188295 | 10/1985 | U.S.S.R. | 52/745.08 |

*Primary Examiner*—Carl D. Friedman
*Assistant Examiner*—Kien Nguyen
*Attorney, Agent, or Firm*—Larry D. Johnson

[57] ABSTRACT

A method of constructing curvilinear structures utilizes an armature mast, an armature boom having a vertically and horizontally pivotable arm terminating in a reinforcing rod (rebar) tying guide, and associated hardware. The tying guide is aligned with a piece of vertical rebar, and a separate piece of horizontal rebar is placed adjacent and generally perpendicular to the vertical rebar for securing thereto. The tying guide is then moved to engage an adjacent piece of vertical rebar, and the horizontal piece is bent inwards for securing thereto. As the armature boom is moved about the mast and progressively raised, further vertical and horizontal pieces of rebar can be brought into juxtaposition and secured, thus generating a non-planar grid of rebar. An impermeable layer is placed over the grid, and a hardening material is applied to form a rigid shell. Further outside and inside base layers may be applied, and further outside and inside surface layers may be applied.

20 Claims, 5 Drawing Sheets

METHOD OF CONSTRUCTING CURVILINEAR STRUCTURES

BACKGROUND OF THE INVENTION

1. Field of the Invention

This invention relates generally to building construction techniques, and more specifically to an improved method for constructing curvilinear structures.

2. Description of the Prior Art

Traditionally, buildings have been erected in generally rectangular configurations with the use of lumber, bricks, blocks and the like. These are rigid materials and may be most easily shaped with straight sides and square corners, which tends to require that structures built with such materials also have the same straight sides and square corners of rectangular configurations. Structures built from these materials have relatively low energy efficiency and require a high level of maintenance. They also tend to be fragile, and are more susceptible to storms, earthquakes, and fire than are other building shapes.

It is well known that curvilinear structures (such as domes) provide numerous benefits in structural integrity, longevity, and design flexibility. Structures with curved walls resist earthquakes, winds, snow loads, leaks, and the like, and are extremely energy efficient. However, the construction of curvilinear structures has been problematic.

Materials such as reinforced concrete can be molded into curved shapes, but forms are required to shape and support such materials in their initial fluid or plastic state. Since concrete forms have been generally constructed of lumber, it has been simpler and more economical to maintain the inherent rectilinear shape in the fabrication of forms and hence rectilinear concrete structures. Construction of wooden forms in complex curved shapes requires a great expenditure of materials, cost, time, and effort. In addition, building construction using concrete has necessitated the erection of two structures: first, wooden or foam forms are built, and secondly, the concrete is poured or sprayed and is temporarily held in place by the forms, then the wooden forms are removed and recycled or discarded.

Previous curvilinear structure construction utilized prefabricated elements or standardized parts limiting design flexibility and strength. Also, previous inventions required the use of off-standard utilities because the resultant structures had no flat walls. For example:

1. GEODESIC DOMES are usually made of wood; lack design flexibility; may constitute a fire hazard; use prefabricated panel kits, which create waste from endeavoring to construct triangular elements from rectangular materials; result in a conventional home built in a round space; and have off-standard utilities because there are no flat walls.
2. AIRFORM-CAST CONCRETE STRUCTURES are ecologically dangerous in foam spraying; use Freon, a fluorocarbon that is damaging the ozone layer; lack design flexibility; have no flat walls; require specially trained workers to build; are a complex construction; and require specialized equipment and materials.
3. STRUCTURAL FORM-CAST CONCRETE STRUCTURES such as those described in Pearcey et al. U.S. Pat. No. 4,352,260 provide a pre-fabricated system consisting of a steel skeleton which serves both as the forming system and as structural members in the finished dome shell, but these lack design flexibility and have aesthetic limitations are more costly than curvilinear structures and have limited openings.

SUMMARY OF THE INVENTION

The method of constructing curvilinear structures of this invention utilizes a precision armature system including a central armature mast portion, an armature boom portion having a vertically and horizontally pivotable arm terminating in a reinforcing rod (rebar) tying guide member, and associated hardware. The tying guide member is aligned with and engages a piece of vertical rebar (e.g., from the foundation slab), and a first separate piece of horizontal rebar is placed adjacent and generally perpendicular to the vertical rebar for securing thereto. Alternatively, the order of alignment may be reversed, with the horizontal rebar placed against the tying guide first, followed by the vertical rebar. The armature boom and tying guide may then be moved generally horizontally to engage the next adjacent piece of vertical rebar, and the first separate horizontal piece is bent inwards towards the tying guide for securing to the vertical rebar. These steps are then repeated with the same or successive separate pieces of horizontal rebar. As the armature boom is moved about the mast and progressively raised relative to the foundation, further vertical and horizontal pieces of rebar can be brought into juxtaposition and secured together, thus generating a generally non-planar (e.g., spherical or other curved) grid of rebar. The radial extension of the pivotable arm, and thus the tying guide, is preferably adjustable at any point in the process, thereby enabling the generation of a non-spherical grid. In addition, the armature boom is preferably vertically adjustable in height relative to the armature mast.

A layer of burlap or other generally impermeable material is placed over the rebar grid, and air-entrained concrete (shotcrete) or other suitable hardening-type material is applied to form a rigid shell. Further outside and inside base layers may be applied, and further outside and inside surface layers (insulative, acoustic, or the like) may be applied.

Thus, the method of constructing curvilinear structures of this invention provides a construction technique for constructing a superior one-piece building that is cost-effective and long-lasting. The method provides a much easier and much faster means of precisely placing the rebar which forms the skeleton, or shaping, of the walls in a very quick manner and which also allows for diversity of design including, but not limited to, domes, elongated structures, domes with open ends or open sides, as well as free-form structures. The method improves the process; it creates a building out of air-entrained shotcrete without using disposable wooden forms or foam forms. The method can be used to create structures that are much stronger than traditional structures, using standardized materials such as shotcrete, burlap, and standard rebar, which create a permanent self-supporting structure.

The curvilinear design readily lends itself to a wide variety of decors and styles, e.g., elliptical, semi-elliptical, parabolic, semi-parabolic, or free-form, and makes the addition of rooms fast, easy, and cost-effective. The rebar weaving system proves extremely inexpensive to form and provides tremendous design flexibility for wall shapes before the shotcrete is sprayed. This creates tremendously complex curvatures as well as conventional right angles, incorporating conventional walls, shotcrete walls, or hollow block walls. Interior wall formation is based on the geometry of soap bubbles; when two or more bubbles touch, a flat surface is created between them. Similarly, where the walls of different rooms meet, there will be flat walls within the structure, easily incorporating conventional furniture and standardized utilities.

DETAILED DESCRIPTION OF A PREFERRED EMBODIMENT

Figure 1:
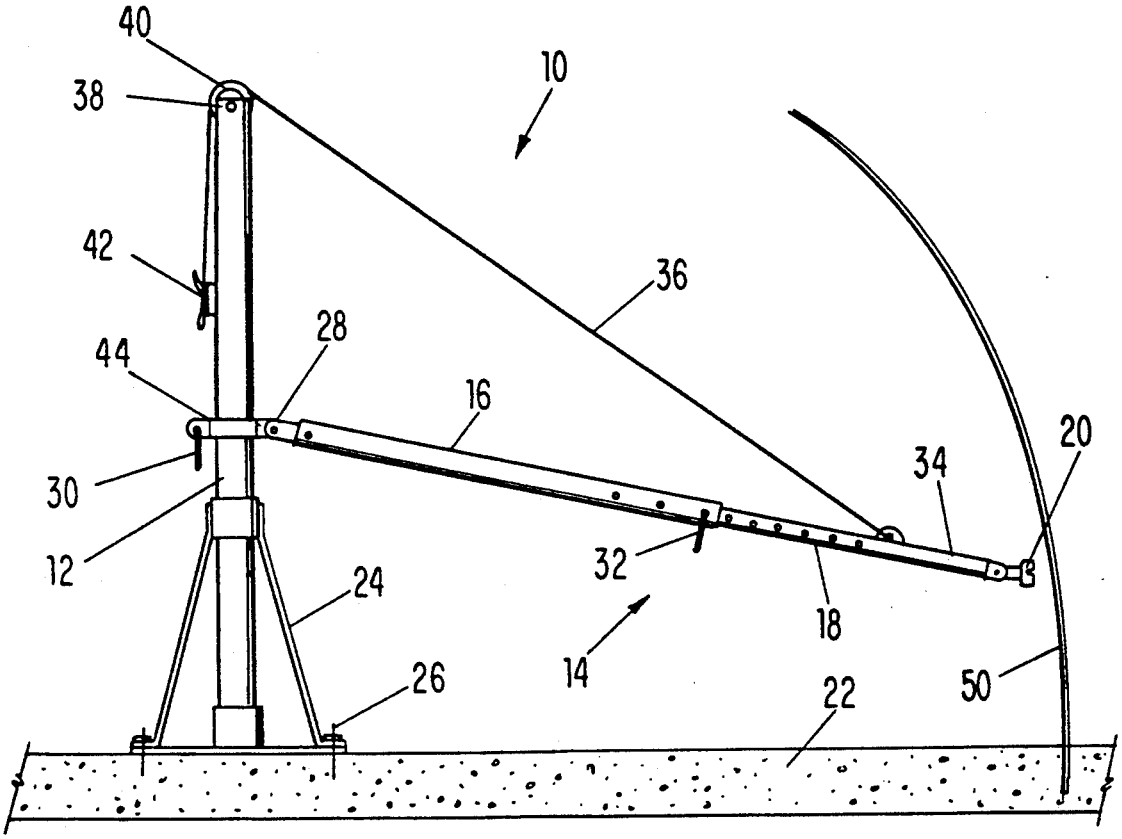
FIG. 1 is a side elevation view of a simplified precision armature system that may be used in the method of constructing curvilinear structures of this invention, this view illustrating a central armature mast portion, a vertically adjustable and vertically and horizontally pivotable armature boom portion having a boom sleeve and an extendable arm terminating in a reinforcing rod (rebar) tying guide member, and associated hardware.

FIG. 1 is a side elevation view of a simplified precision armature system 10 that may be used in the method of constructing curvilinear structures of this invention, this view illustrating a central armature mast portion 12, a vertically adjustable and vertically and horizontally pivotable armature boom portion 14 having a boom sleeve 16 and an extendable arm 18 terminating in a reinforcing rod (rebar) tying guide member 20.

Armature mast 12 may be secured to foundation slab 22 by tripod base 24 and nails or bolts 26, and may be designed to telescope or otherwise be adjustable in height. Armature boom 14 may be selectively secured at any point on mast 12 and in a given vertical angular relationship relative to mast 12 via pivot 28 and locking lever 30, which may comprise a cam-type lock, screw lock, recessed pins, or any other known securing method. Similarly, extendable arm 18 may be selectively secured in a given length relative to boom sleeve 16 by locking lever 32. Boom end 34 may be further supported by support cable 36, secured to mast top 38 via pulley 40 and cleat 42. Armature boom 14 is enabled to rotate about the vertical axis of armature mast 12 by any of numerous methods, including pivoting of the entire mast structure within the tripod base, providing a rotating collar 44, or the like.

Tying guide 20 is placed against and aligned with a piece of vertical rebar 50 previously placed in foundation slab 22, so that a separate piece of horizontal rebar may be placed against and secured to the vertical rebar, as described infra.

Figure 2:
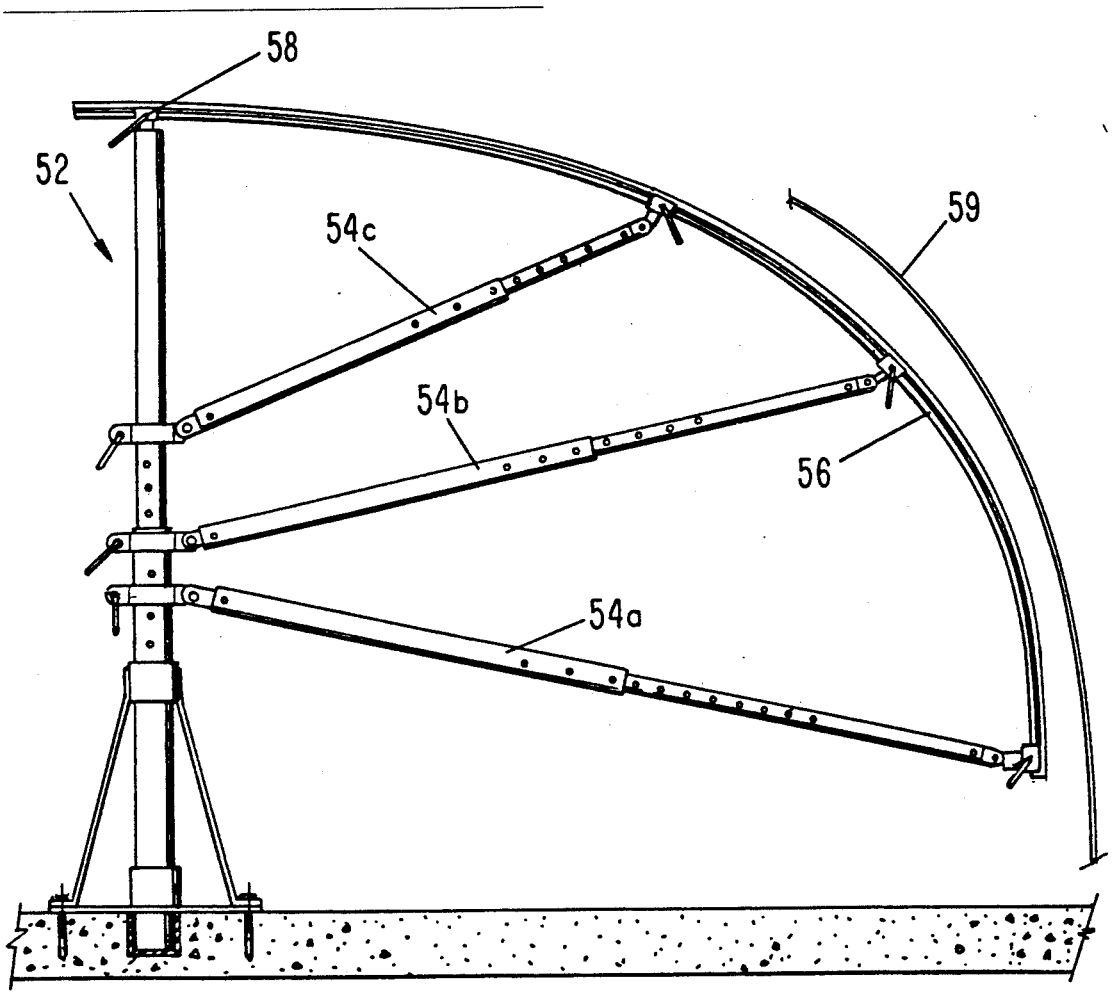
FIG. 2 is a modified precision armature system that may be used in the method of constructing curvilinear structures of this invention, having a plurality of armature booms laterally supporting a flexible vertical rebar track.

FIG. 2 is a modified precision armature system 52 that may be used in the method of constructing curvilinear structures of this invention, having a plurality of armature booms **54*a*, 54*b*, and 54*c* laterally supporting a flexible vertical rebar track 56, which extends past and is slidingly captured by mast top 58. Use of this arrangement may significantly reduce or even eliminate the vertical pivoting adjustment normally required with only one armature boom. Here, a piece of vertical rebar 59 may be bent against flexible track 56**, for simultaneous tying to separate pieces of horizontal rebar.

Figure 3:
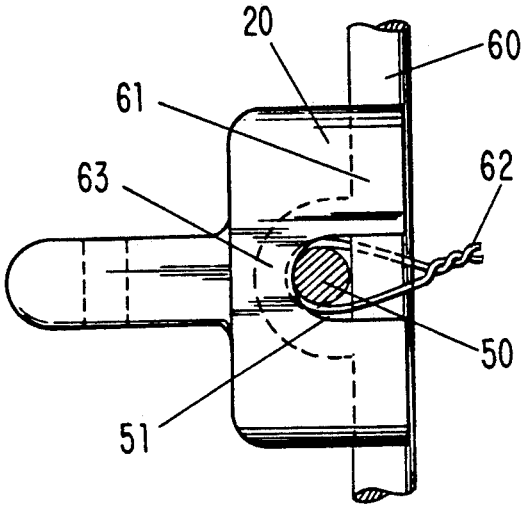
FIG. 3 is a top plan view in partial cross-section of an armature boom end rebar tying guide member used in the method of this invention, illustrating the tying guide member alignment with and engagement of a piece of vertical rebar from the foundation slab, with a separate piece of horizontal rebar being placed adjacent and generally perpendicular to the vertical rebar for securing thereto.

FIG. 3 is a top plan view in partial cross-section of an armature boom end rebar tying guide member 20 used in the method of this invention, illustrating the tying guide member alignment with and engagement of a piece of vertical rebar 50 from the foundation slab, with a separate piece of horizontal rebar 60 being placed adjacent and generally perpendicular to the vertical rebar. Vertical rebar 50 generally fits within vertical rebar receiving channel 51, while horizontal rebar 60 generally fits over vertical rebar 50 and into horizontal rebar receiving channel 61. Alternatively, the relative depth of these receiving channels may be reversed, with the horizontal rebar being placed into the tying guide first, and the vertical rebar placed over it for tying. Tie wire 62 can be threaded behind both of these pieces through wire access channel or depression 63, and twisted together at the front to secure the rebar together.

Figure 4:
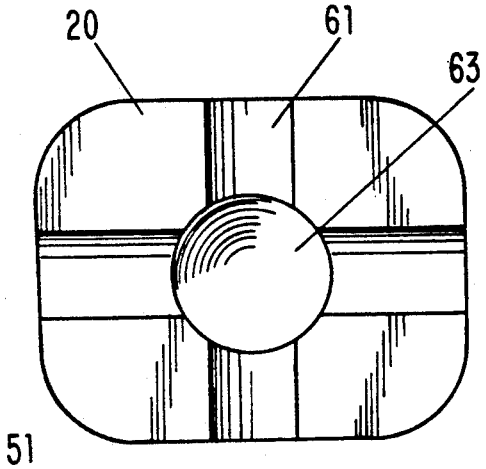
FIG. 4 is a front elevation view of the armature boom end tying guide of FIG. 3, illustrating a vertical rebar receiving channel, horizontal rebar receiving channel, and wire access channel.

FIG. 4 is a front elevation view of the armature boom end tying guide 20 of FIG. 3, illustrating a vertical rebar receiving channel 51, horizontal rebar receiving channel 61, and wire access channel or depression 63.

Figure 5:
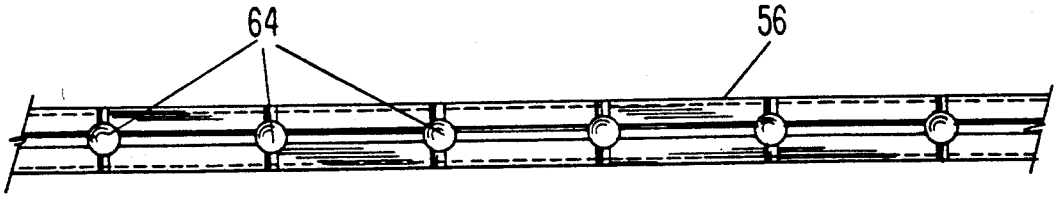
FIG. 5 is an end elevation view of a portion of the flexible vertical rebar track of FIG. 2, bearing a vertically arranged plurality of tying guide members for simultaneously securing a plurality of horizontal rebar elements to a single vertical rebar element.

FIG. 5 is an end elevation view of a portion of the flexible vertical rebar track 56 of FIG. 2, bearing a vertically arranged plurality of tying guide members 64 for simultaneously securing a plurality of horizontal rebar elements to a single vertical rebar element. This flexible rebar track may be laterally supported by one or several armature booms and may serve to reduce the number of armature boom pivoting steps normally required to fully generate a rebar grid.

Figure 6:
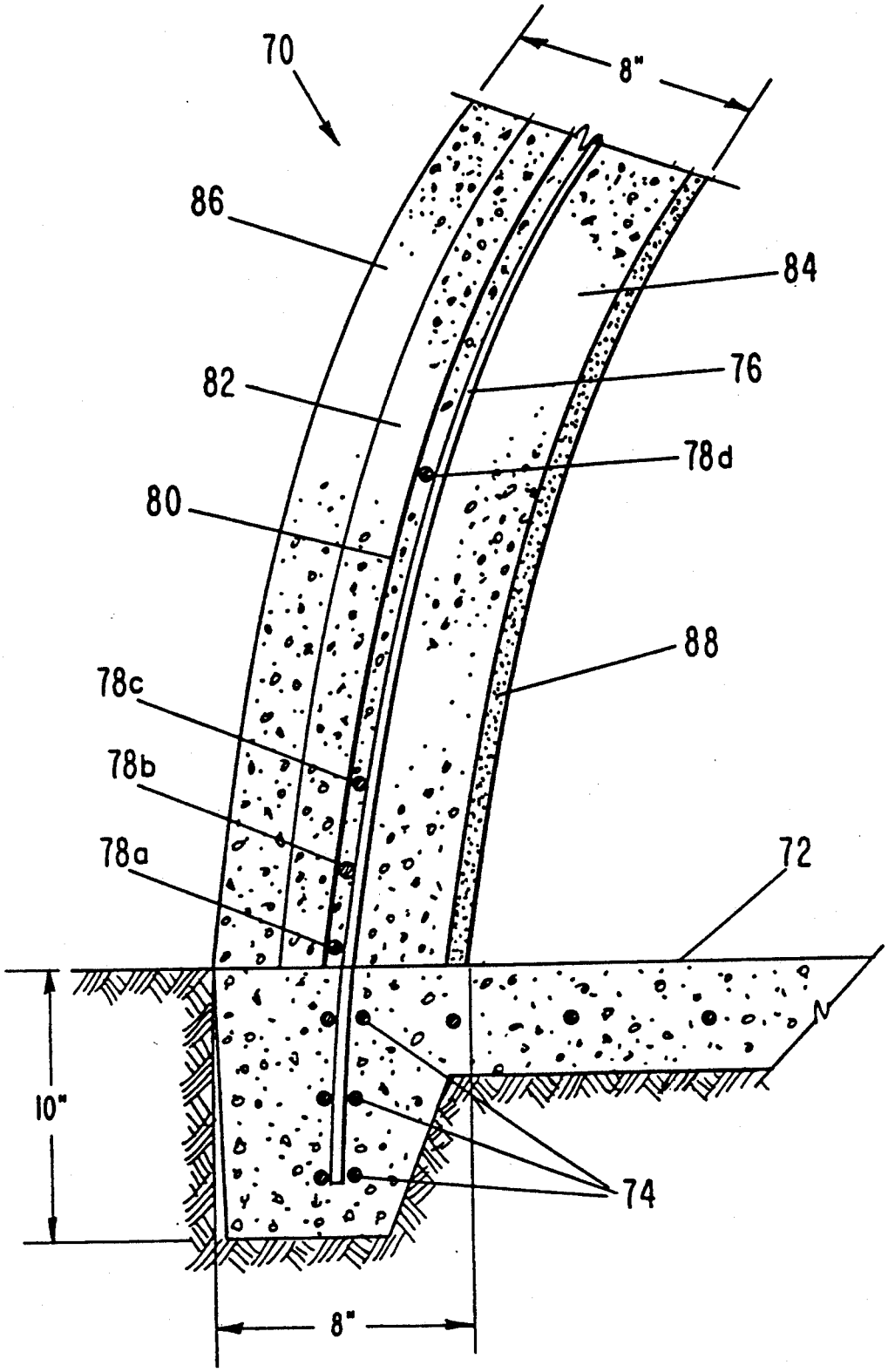
FIG. 6 is a side elevation cross-sectional view of a portion of a curvilinear structure constructed with the method of this invention, and illustrating a foundation slab with a plurality of circumferential rebar elements surrounding a single vertical rebar element; a series of horizontal rebar elements having been attached to the vertical rebar element in accordance with the method of this invention; a burlap layer over the rebar grid; outside and inside base shotcrete layers; and outside and inside surface layers.

FIG. 6 is a side elevation cross-sectional view of a portion of a curvilinear structure 70 constructed with the method of this invention, and illustrating a foundation slab 72 with a plurality of circumferential rebar elements 74 surrounding a single vertical rebar element 76; a series of horizontal rebar elements **78*a–d* having been attached to the vertical rebar element 76 in accordance with the method of this invention; a burlap or other impermeable layer 80 over the rebar grid; outside and inside base shotcrete layers 82, 84; and outside and inside surface or texture layers 86, 88**.

Figure 7:
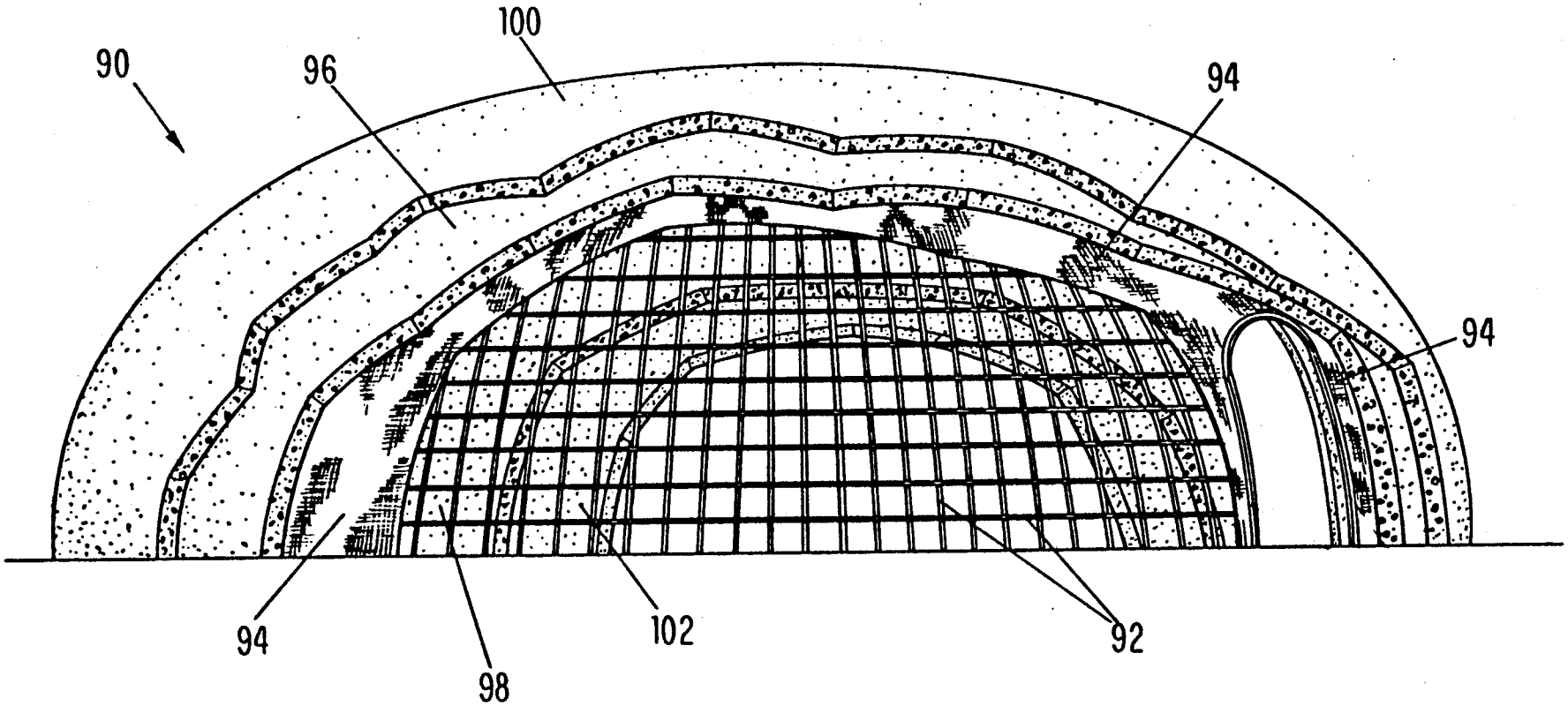
FIG. 7 is a side elevation view in partial cross-section of a curvilinear structure constructed by the method of this invention.

FIG. 7 is a side elevation view in partial cross-section of a curvilinear structure 90 constructed by the method of this invention. This view better illustrates one particular weave of the rebar grid 92 (other weaves, e.g., spiral, are of course possible and may be preferable), burlap layer 94, outside and inside base shotcrete layers 96, 98, and outside and inside surface layers 100, 102.

The method of this invention may be accomplished in the following manner. A foundation and floor slab are formed and poured in accordance with standard construction techniques. Water and sewer piping, raceways, ducting, etc., are placed under the foundation. The foundation and floor slab preferably include reinforcing rods or members. Further reinforcing rods (rebar) extend upwards from the outer edge of the foundation (recessed in from the outer edge about five inches or more depending upon engineering specifications) to a height of four to six feet, spaced equally at a distance of twelve inches, ultimately to become the wall of the structure. This peripheral border is preferably generally circular, but may be made in any shape. If footers are necessary for archways, they are constructed at the same time as the foundation.

A removable plastic plug of the same size as the armature mast is placed in the concrete area before pouring the slab to create a hole deep enough to go through the foundation slab, for later placement of the armature mast in the foundation; for example, if the determined shape is a hemisphere, it should be put in the exact center of the structure. When the foundation is dry, the plastic plug should be removed from the foundation, resulting in a hole for the placement of the armature mast. The tripod is then placed over the hole, and the mast of the armature system is carefully inserted through the tripod into the hole in the concrete. The tripod of the mast support system may be leveled with shims. Another option would be to shoot nails into the tripod, if desired.

Adjust the proper height and the proper distance of the armature by loosening the locking levers (adjustment screws, pins, or their equivalent) on the armature boom and loosening the support cable. Carefully swing the boom over to the foundation and follow it around to ensure that is positioned properly. If any adjustments need to be made in the height or length of the boom system, they are made at this step. When placing the armature system in the hole in the foundation, make sure that it is appropriately leveled. The mast must be at ninety degrees to the foundation; this should be checked with a square or level. Swing the armature boom over to the edge of the wall to check that the boom is adjusted properly, tightening the locks and cable. Carefully move the rebar into a spiral left/right direction, i.e., a spiral weave generation system. Starting at the base of the wall, tie in the first two levels of horizontal rebar at three to four inches apart. Each row after that will be at twelve to sixteen inches apart, depending upon engineering specifications.

The top six to eight inches of the foundation (or wall) serves as a tension ring, which means that it contains five or six times the density of rebar as the rest of the walling system. This prevents spreading under the weight of the structure. The rebar is placed around three to four times in the foundation ring itself.

The armature mast system gradually creates the desired curvature of the rebar by determining the proper placement which ultimately becomes the final shape of the finished wall. The armature system can also be adjusted at any point during construction. This feature is especially useful for the creation of a free-form structure.

The armature system consists of a mast and boom that is adjustable horizontally as well as vertically. Once the proper wall curvature has been determined, the armature is adjusted to the desired length and height starting at the base of the foundation, and the three-eighths inch (or other suitable diameter) rebar is placed on the rest of the structure. The armature is moved into place behind the vertical rebar, which is bent against the end of the armature system; then the horizontal rebar is held in place against the vertical rebar, crossing every twelve inches to create a twelve inch by twelve inch weave (or sixteen by sixteen inches, depending upon engineering specifications), and tied twice from two different directions with tie wire. Be sure to tie carefully. Then the arm is moved to the next vertical rebar and the cycle is repeated. This creates a weave of rebar, gradually forming the developing design shape of the final curved walls. The horizontal rebar that is tied should be laid in such a way that it curves nicely and does not lie flat.

The rebar weave is very forgiving of minor errors, but horizontal rebar should not be flat or straight across between vertical rebar. This can be checked with the armature system.

When tying one rebar to another, the vertical rebar must overlap down to about twenty-four inches to thirty-six inches below the top rebar. As the rods rise during the weaving process, they will come closer together at the top. Assuming that the rods used are ten to twenty feet long, the second lift of rods should be overlapped about twenty-four to thirty-six inches below the tops of the first lift. This same process is repeated for each bar until the top is reached.

Reinforcing for special openings or for extra strength is constructed as required. In any area where doors, windows, or other openings are planned, the concrete around these openings should be reinforced with additional rebar.

In the course of construction, if desired, large wall openings may be readily provided within the wall. This is accomplished simply by cutting out the rebar and reinforcing the edge surrounding the opening with extra rebar.

If conventional walls are desired, they can be built in place under the archways, or the convention flat walls can be built out of hollow block and the armature system can be used to create the desired curved ceilings or roofs.

The burlap serves as a spraying surface for the shotcrete. Other reinforcing mesh may also be used, such as chicken wire, hardware cloth, and the like.

The technique for applying the burlap on ellipsoid domes or open-ended domes; start by placing the roll of burlap on top of the structure and tying it with the wire. Unroll it straight down the side with a twelve inch overlap along the edges of each layer of burlap, gently pulling the burlap tight enough to remove major wrinkles and tying it in place with tie wire at twelve to twenty-four inch increments.

The technique for applying burlap on the high domed sections of the structure; start at the base of the rebar wall, attaching the burlap horizontally to the rebar with tie wire, and unroll the burlap while walking around the structure, overlapping one foot as you proceed. Tie in place with tie wire at twelve to twenty-four inch increments.

The shotcrete is sprayed on the same level all the way around the rebar-burlap frame, rather than all on one side, preventing shifting of the frame. Depth gauges are tied onto the rebar-burlap layer prior to the shotcreting process to continually gauge the thickness. Small concrete blocks made of the same material as the wall (e.g., shotcrete) may be used as depth indicators for uniform thickness during the shotcrete spraying process. These depth gauges are tied with tie wire on the outside surface of the burlap-rebar form to determine the proper wall thickness during shotcrete spraying. They should be applied over the entire surface of the building on a five foot grid, all the way around the structure. They become an integral part of the finished shotcrete wall.

After the depth indicators are in place, the electrical cables are tied to the rebar on the outside of the burlap frame.

By means of the thickness gauges, the shotcrete operator judges the thickness of the layer as it is being sprayed on in the multi-layer system, and uniformly covers the burlap form to the depth of the gauges. The shotcrete will harden quickly and will become integral with the gauge blocks to constitute the uniform layer progressing up the wall. The thickness of the shotcrete at the base of the wall is approximately eight inches. The rest of the wall should be a minimum thickness of four inches, tapering from eight inches at the base to four inches at the top. If exterior insulation is required, it can be sprayed on later in a similar manner (insulative shotcrete process).

The shotcrete spraying operation should start at the base or lower portions of the structure; spraying is continued upward so that the spraying of the structure is completed at the top. Each additional sprayed area of the layer receives support from the previously sprayed areas which have hardened, and no undue strain will be placed upon the rebar and burlap frame. For larger structures, the spraying operation may be done in successive layers, with walls of adequate thickness and strength to support itself and additional layers of shotcrete without assistance.

Using temporary bracing poles may be desirable for the shotcrete layers when spans are substantial, until the shotcrete layers have cured and become completely self-supporting, or if there is a desire to ellipse the structure, after the wearing of the rebar is completed. Have all necessary internal bracing poles in place before you start the shotcrete step.

Properly made air-entrained concrete (shotcrete) will never rot even though subjected to moisture. The thermal coefficient of shotcrete and rebar is nearly identical, making them ideally matched construction materials.

The armature system may be removed by simply reversing the armature installation steps. The exterior surface of the still-wet shotcrete may be smoothed out in a conventional manner with trowels, or with rollers, or both. After twenty-eight to thirty days, the shotcrete has hardened sufficiently to be earth bermed if desired. Fill in the armature boom hole with concrete and trowel it smooth. A layer of concrete mixture may be plastered on or sprayed against the interior surface of the wall after the shotcrete layer has been sprayed on the inside surface.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A method of constructing a curvilinear structure comprising the steps of:

preparing a foundation having a plurality of vertical reinforcement elements disposed about its periphery;

providing an armature having a vertical mast positioned at a point on said foundation within said periphery, said armature having a vertically and horizontally pivotable boom terminating in a reinforcement element tying guide member;

pivoting said armature boom so that said tying guide member engages one of said foundation vertical reinforcement elements at a point;

placing a horizontal reinforcement element adjacent said point on said vertical reinforcement element, and securing said horizontal reinforcement element to said vertical reinforcement element proximate said point;

pivoting said armature boom so that said tying guide member engages an adjacent vertical reinforcement element at a point, and securing said horizontal reinforcement element to said adjacent vertical reinforcement element at that point;

repeating such pivoting and securing step to construct a non-planar grid of reinforcement elements;

placing a layer of generally impermeable material over at least a portion of said constructed grid; and placing an initially liquid but hardening construction material over at least a portion of said generally impermeable material to form a rigid shell.

2. The method of constructing a curvilinear structure of claim 1 further including the step of:

providing a radially extendable armature boom, and maintaining said radially extendable armature boom in a specific radial extension during the construction to generate a generally spherical grid.

3. The method of constructing a curvilinear structure of claim 1 further including the step of:

providing a radially extendable armature boom, and adjusting said radially extendable armature boom to different radial extensions during the construction of said grid.

4. The method of constructing a curvilinear structure of claim 1 further including the step of:

moving said armature boom about said vertical mast to generate a spiral path of horizontal reinforcement elements in said grid.

5. The method of constructing a curvilinear structure of claim 1 further including the step of:

providing an armature having a plurality of pivotable booms each terminating in a reinforcement element tying guide member, and pivoting each of said armature booms so that each of said tying guide members engages the same vertical reinforcement element simultaneously.

6. The method of constructing a curvilinear structure of claim 1 further including the step of:

providing a tripod base for said armature vertical mast.

7. The method of constructing a curvilinear structure of claim 1 further including the step of:

providing a removable plug in said foundation for placement of said armature mast.

8. The method of constructing a curvilinear structure of claim 1 further including the step of:

providing a generally equally-spaced array of vertical reinforcement elements about the periphery of said foundation to at least partially define the shape of the base of the structure.

9. The method of constructing a curvilinear structure of claim 1 further including the step of:

securing said horizontal reinforcement elements to said vertical reinforcement elements with tie wire.

10. The method of constructing a curvilinear structure of claim 1 further including the step of:

providing a vertical channel in said reinforcement element tying guide member to engage said vertical reinforcement elements.

11. The method of constructing a curvilinear structure of claim 1 further including the step of:

providing a horizontal channel in said reinforcement element tying guide member to engage said horizontal reinforcement elements.

12. The method of constructing a curvilinear structure of claim 1 further including the step of:

providing a depression in said reinforcement element tying guide member to enable passage of securing material around said vertical and horizontal reinforcement elements.

13. The method of constructing a curvilinear structure of claim 1 further including the step of:

providing a plurality of horizontal channels in said reinforcement element tying guide member to simultaneously engage a plurality of said horizontal reinforcement elements.

14. The method of constructing a curvilinear structure of claim 1 further including the step of:

placement of thickness gauges upon said impermeable material to indicate the preferred depth of hardening material to be applied.

15. The method of constructing a curvilinear structure of claim 1 further including the step of:

applying burlap over said constructed grid of reinforcement elements to form a generally impermeable layer.

16. The method of constructing a curvilinear structure of claim 1 further including the step of:

applying air-entrained concrete over said layer of impermeable material to form a rigid shell.

17. The method of constructing a curvilinear structure of claim 1 further including the step of:

applying at least one further layer of a hardening material over said hardening construction material rigid shell.

18. The method of constructing a curvilinear structure of claim 1 further including the step of:

applying at least one layer of a hardening material on the inside surface of said constructed grid.

19. The method of constructing a curvilinear structure of claim 1 further including the step of:

providing a flexible vertical reinforcement element track member at the terminus of said pivotable boom; and placing a vertical reinforcement element against said track member to enable the simultaneous securing of a plurality of horizontal reinforcement elements to said vertical element.

20. The method of constructing a curvilinear structure of claim 19 further including the step of:

slidably capturing said flexible vertical reinforcement element track member with said vertical mast.

* * * * *